US009638180B2

(12) United States Patent
Sell et al.

(10) Patent No.: US 9,638,180 B2
(45) Date of Patent: May 2, 2017

(54) HYDROSTATIC AXIAL PISTON MACHINE HAVING A CYLINDER BARREL WITH A WORKING PISTON WHICH IS MOUNTED OBLIQUELY WITH RESPECT TO ITS AXIAL DIRECTION AND WITH A PLANAR CONTROL PLATE

(71) Applicant: Robert Bosch GmbH, Stuttgart (DE)

(72) Inventors: Manuel Sell, Horb (DE); Frank Zehnder, Denkendorf (DE); David Breuer, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 366 days.

(21) Appl. No.: 14/273,531

(22) Filed: May 8, 2014

(65) Prior Publication Data

US 2014/0334948 A1 Nov. 13, 2014

(30) Foreign Application Priority Data

May 8, 2013 (DE) ..... 10 2013 208 454

(51) Int. Cl.
*F04B 1/20* (2006.01)

(52) U.S. Cl.
CPC ..... *F04B 1/2078* (2013.01); *F04B 1/2021* (2013.01); *F04B 1/2035* (2013.01); *F04B 1/2092* (2013.01)

(58) Field of Classification Search
CPC ..... F04B 1/20; F04B 1/2007; F04B 1/2021; F04B 1/2035; F04B 1/2028; F04B 1/2042; F04B 1/2092; F04B 1/2014; F04B 1/2071; F01B 3/0038; F01B 3/0041; F01B 3/0052; F01B 3/0047; F01B 3/0067
See application file for complete search history.

(56) References Cited

U.S. PATENT DOCUMENTS 4,602,554 A * 7/1986 Wagenseil ..... F04B 1/2007 91/486
2005/0226748 A1* 10/2005 Gray, Jr. ..... F04B 1/2021 417/440

FOREIGN PATENT DOCUMENTS

| | | |
|---|---|---|
| DE | 34 13 059 C1 | 7/1985 |
| DE | 40 35 748 A1 | 5/1991 |
| DE | 197 06 263 C1 | 7/1998 |
| DE | 10 2008 012 593 A1 | 6/2009 |
| DE | 10 2010 006 895 A1 | 8/2011 |
| GB | 1 073 216 | 6/1967 |

* cited by examiner

*Primary Examiner* — Devon Kramer
*Assistant Examiner* — Kenneth J Hansen
(74) *Attorney, Agent, or Firm* — Maginot, Moore & Beck LLP

(57) ABSTRACT

An axial piston machine of swash plate design includes cylinder bores with respective longitudinal axes that are arranged at an acute angle with the rotational axis and that approach the rotational axis radially in the direction of their control plate-side ends. For each cylinder bore, a point of action of a resulting hydrostatic relieving force, which acts on the cylinder barrel, of the hydrostatic sliding bearing is spaced apart radially with regard to the rotational axis of the cylinder barrel further than a point of intersection of the longitudinal axis of the cylinder bore with the cylinder barrel-side bearing face of the hydrostatic sliding bearing.

12 Claims, 7 Drawing Sheets

HYDROSTATIC AXIAL PISTON MACHINE HAVING A CYLINDER BARREL WITH A WORKING PISTON WHICH IS MOUNTED OBLIQUELY WITH RESPECT TO ITS AXIAL DIRECTION AND WITH A PLANAR CONTROL PLATE

This application claims priority under 35 U.S.C. §119 to patent application no. DE 10 2013 208 454.4 filed on May 8, 2013 in Germany, the disclosure of which is incorporated herein by reference in its entirety.

BACKGROUND

The disclosure relates to a hydrostatic axial piston machine configured as a hydraulic pump or as a hydraulic motor or configured to be operated both as a hydraulic pump and as a hydraulic motor.

Axial piston machines are known, in which the cylinder barrel and a control plate (also called control disk) lie on one another with planar bearing faces, and the cylinder bores and/or the working pistons which are mounted displaceably therein are arranged parallel to the rotational axis of the drive shaft, as is disclosed, for example, in DE 10 2010 006 895 A1. It is also known to design the bearing faces of the cylinder barrel and control plate to be spherical and to arrange the cylinder bores and the working pistons parallel to the rotational axis of the drive shaft, as shown, for example, in DE 34 13 059 C1 (FIG. 1) or in DE 197 06 263 C1. Furthermore, it is known to design the bearing faces of the cylinder drum and control plate to be spherical and to arrange the cylinder bores and the working pistons obliquely with respect to the rotational axis of the drive shaft, cylinder bores approaching the rotational axis radially in the direction of the bearing face, as disclosed, for example, in DE 34 13 059 C1 (FIGS. 2 and 3) or in DE 10 2008 012 593 A1. Finally, it is known to design the bearing faces of the cylinder drum and control plate to be planar and to arrange the cylinder bores and the working pistons obliquely with respect to the rotational axis of the drive shaft, as is disclosed, for example, in GB 1 073 216 or in DE 40 35 748 A1 (FIG. 2).

During the passage of a working pressure medium from an inlet line of an axial piston machine through a control opening in the control plate and into a cylinder bore which is delimited in sections by a working piston, that is to say into the working space, the working pressure medium is accelerated to a very pronounced extent on account of the high circumferential speed of the working spaces in the cylinder barrel which optionally also rotates rapidly. As a consequence, known axial piston machines reach the cavitation range during operation at high rotational speeds and are limited with regard to the rotational speed which can be achieved. This problem can be reduced if the inlet openings of the working spaces are arranged closer to the rotational axis of the cylinder barrel, that is to say radially further to the inside, because the circumferential speed also decreases together with the radius. In this regard, constructions of the cylinder barrel are advantageous, in which the cylinder bores and the working pistons are arranged obliquely with respect to the rotational axis of the drive shaft and the inlet openings of the working spaces are arranged radially closer to the rotational axis.

On account of the functional principle of axial piston machines of this type, the cylinder barrel is pressed with a comparatively high force against the stationary control plate, with the result that considerable wear can take place on the bearing faces of the control plate and cylinder barrel during operation of the axial piston machine. In axial piston machines having a planar control plate, in order to reduce said wear, the substantially circularly annular bearing faces are configured as a hydrostatic bearing which is lubricated by operating pressure medium which, as a consequence of the high pressure which is present in the inlet opening of a working space, is driven into the gap which is formed between the bearing faces and contributes to the leakage losses during operation of the axial piston machine. The radial dimensions of the hydrostatic bearing, including the radii of its inner and outer boundaries, are defined by at least one of the bearing faces on the cylinder barrel and the control plate as a circularly annular elevation with a circular inner step and a circular outer step in order to form the inner and outer boundary of the bearing face. A gap is formed during operation between the bearing faces of the hydrostatic bearing, into which gap the operating pressure medium penetrates under the action of the high pressure. Correspondingly, a relieving force which acts on the bearing faces is produced in the hydrostatic bearing in the direction perpendicularly with respect to the respective bearing face. Thus, in the case of a planar control plate with planar, circularly annular bearing faces, a relieving force acts on the cylinder barrel in the axial direction toward the swash plate, as shown in FIGS. 3 to 5. This applies analogously to contact of a cylinder barrel with a spherical control plate, the bearing faces being of spherical configuration. However, in the case of spherical bearing faces, a relieving force which is produced in the spherical gap does not act axially, but rather perpendicularly with respect to the spherical bearing face at an acute angle with respect to the rotational axis of the cylinder barrel, as shown in FIG. 2. The relieving force which acts on the control plate is absorbed by virtue of the fact that, on its side which faces away from the cylinder barrel, the control plate is arranged on the housing of the axial piston machine such that it is supported axially in a pivot bearing. The relieving force which acts on the cylinder barrel is absorbed by the cylinder barrel being mounted rotatably in its swash plate-side end which is opposite to the control plate-side end, in a manner which is supported axially on the housing of the axial piston machine, and being arranged such that it is prestressed axially in the direction of the control plate via a compression spring.

On the foot side, the working pistons are supported on the swash plate. To this end, a piston foot of each working piston is of ball-shaped configuration and is connected in an articulated manner to a piston shoe which slides on the swash plate during rotation of the cylinder barrel. To this end, on the swash plate side, the piston shoe has a planar sliding face which bears in a slidable manner against the swash plate on a lubricating film which is formed by a pressure medium. If a working space is loaded with pressure medium, the working piston is pressed by its piston shoe in the direction of the cylinder bore against the swash plate. The swash plate absorbs this force and, on the sliding face of the piston shoe, a relieving force or counterforce is produced by the piston shoe on the working piston, which relieving force or counterforce acts in a direction perpendicularly with respect to the sliding face or swash plate. If the swash plate is arranged in its basic position, in which the swash plate lies perpendicularly with respect to the rotational axis of the cylinder barrel, the relieving force which is produced on the piston shoe acts on the working piston in the axial direction.

The present disclosure relates to axial piston machines of swash plate design having the configuration which was mentioned at the outset and is disclosed, for example, in GB 1 073 216 or in DE 40 35 748 A1 (FIG. 2), in which configuration the bearing faces of the cylinder barrel and control plate are of planar design and the cylinder bores and the working pistons are arranged obliquely with respect to the rotational axis of the drive shaft. In a configuration of this type, the lines of action of the relieving forces which act on the cylinder barrel are offset with respect to one another on the control plate and on the piston shoe radially with regard to the rotational axis of the cylinder barrel, the relieving force on the control plate being arranged radially closer to the rotational axis, as shown, for example, in FIGS. 3 to 5. A tilting moment which acts on the cylinder barrel is produced on account of the radial offset of the relieving forces on the cylinder barrel at the control plate and at the piston shoe.

In comparison with known axial piston machines in the configuration with bearing faces of planar design of the cylinder drum and control plate and the cylinder bores and working pistons which are arranged obliquely with respect to the rotational axis of the drive shaft, in which the configuration of its driving mechanism has already been optimized with regard to costs, installation space, degree of efficiency, the function and rotational speed which can be achieved of the driving mechanism (approximately 6000 rpm) at a high degree of efficiency, the disclosure is based on the object of providing an axial piston machine, in which the tilting moment which acts on the cylinder barrel as a result of the relieving forces on the control plate and on the piston shoe is small or is avoided.

SUMMARY

In order to achieve this object, an axial piston machine of swash plate design having the following is provided: a cylinder barrel which is mounted such that it can be rotated about a rotational axis, in which cylinder barrel a multiplicity of cylinder bores are formed which are delimited in sections by in each case one working piston and, during the rotation of the cylinder barrel, can be connected to high pressure or low pressure via a planar control plate which bears against an end side of the cylinder barrel via bearing faces of a hydrostatic sliding bearing, and having a swash plate which is mounted pivotably in a pivoting bearing and on which piston shoes which are arranged at the swash plate-side end of the working piston slide during the rotation of the cylinder barrel. Here, the longitudinal axes of the cylinder bores are arranged at an acute angle with the rotational axis and approach the rotational axis radially in the direction of their control plate-side ends.

According to the disclosure, the axial piston machine is configured in such a way that, for each cylinder bore, a point of action, and correspondingly a line of action, of a resulting hydrostatic relieving force, which acts on the cylinder barrel, of the hydrostatic sliding bearing is spaced apart radially with regard to the rotational axis of the cylinder barrel further than a point of intersection of the longitudinal axis of the cylinder bore with the cylinder barrel-side bearing face of the hydrostatic sliding bearing. The tilting moment on the cylinder barrel becomes smaller by virtue of the fact that the point of action or the line of action of the relieving force of the hydrostatic sliding bearing is arranged with regard to the rotational axis radially further to the outside than the point of intersection of the longitudinal axis of the cylinder bore with the bearing face of the sliding bearing. The tilting moment becomes smaller, the further the point of action or the line of action of the relieving force of the sliding bearing is spaced apart radially from the rotational axis. If the point of action or the line of action of the relieving force on the hydrostatic sliding bearing is spaced apart radially with regard to the rotational axis of the cylinder barrel to the same extent as an axial component of the relieving force on the piston shoe, the tilting moment is at a minimum or is compensated for in an optimum manner.

The point of action or the line of action of the resulting hydrostatic relieving force, which acts on the cylinder barrel, of the hydrostatic sliding bearing can be spaced apart radially with regard to the rotational axis of the cylinder barrel to substantially the same extent as a point of action or a line of action of a resulting relieving force, which acts on the cylinder barrel, on a bearing face of the piston shoe on the swash plate. In this refinement, the tilting moment is at a minimum or is compensated for in an optimum manner or is avoided.

As an alternative to this, the point of action or the line of action of the resulting hydrostatic relieving force, which acts on the cylinder barrel, of the hydrostatic sliding bearing can also be spaced apart radially with regard to the rotational axis of the cylinder barrel further than the point of action or the line of action of the resulting relieving force, which acts on the cylinder barrel, on the bearing face of the piston shoe on the swash plate. In this refinement, the tilting moment is over-compensated. The point of action or the line of action which is displaced radially further to the outside of the relieving force of the hydrostatic sliding bearing increases a supporting action on the cylinder barrel and makes it possible to achieve higher limiting rotational speeds.

A multiplicity of passage slots which are assigned to the respective cylinder bores and extend from the distal end of the respective cylinder bore as far as the cylinder barrel-side bearing face of the hydrostatic sliding bearing can be formed at the control plate-side end of the cylinder barrel. In this refinement, a point of action of the relieving force of the hydrostatic sliding bearing lies in the point of intersection between a longitudinal axis of a passage slot and the cylinder barrel-side bearing face of the hydrostatic sliding bearing. If a passage slot or passage slots are mentioned here and in the following text, this is also to include passage bores, that is to say passage slots which are circular and represent a borderline case for a passage slot which has a greater extent in one direction than in the direction which is perpendicular with respect thereto.

In this refinement, longitudinal axes of said passage slots can be arranged substantially parallel to the rotational axis of the cylinder barrel. Here, on account of the geometry, because the course of the longitudinal axis of the cylinder bore in the direction of the control plate, which longitudinal axis runs at an acute angle with respect to the rotational axis, approaches the rotational axis further in the region of the passage slots, the longitudinal axes of the passage slots running substantially parallel to the rotational axis, the point of action of the relieving force on the sliding bearing is spaced apart radially further from the rotational axis than the point of intersection of the longitudinal axis of the cylinder bore with the cylinder barrel-side bearing face of the hydrostatic sliding bearing.

In order to further increase the radial spacing of the point of action of the relieving force, which acts on the cylinder barrel, on the control plate, the longitudinal axes of the passage slots can be spaced apart radially in relation to the rotational axis of the cylinder barrel further than the points of intersection of the longitudinal axes of the cylinder bores with a plane which is arranged perpendicularly with respect to the rotational axis and contains the cylinder bore-side ends of the passage slots. Here, in particular, the cylinder bore-side ends of the passage slots can be spaced apart radially with regard to the rotational axis further than the points of intersection of the longitudinal axis of the cylinder bores with the above-mentioned plane.

In the above-described refinements with passage slots, the control plate-side end of the longitudinal axis of the passage slots which is assigned to each working piston can be spaced apart radially for each said working piston with regard to the rotational axis of the cylinder barrel radially to substantially the same extent as, or can be spaced apart further than, a point of action or a line of action of a relieving force which acts on the piston shoe on a bearing face of the associated piston shoe on the swash plate and, as a result, on the working piston in the axial direction.

As an alternative or in addition to the above-described options of displacing the point of action or the line of action of the relieving force of the hydrostatic sliding bearing radially further to the outside, that is to say spaced further apart, with regard to the rotational axis of the cylinder barrel by means of passage slots which extend from the distal end of the respective cylinder bore as far as the cylinder barrel-side bearing face of the hydrostatic sliding bearing, there are the possibilities described in the following text for achieving this effect, to be precise by way of a special structural design of the hydrostatic sliding bearing.

In a known way, the hydrostatic sliding bearing is of annular configuration, comprises the cylinder barrel-side bearing face and the control plate-side bearing face, and has an inner circular boundary and an outer circular boundary. Correspondingly, the control plate is of substantially annular configuration and has at least two, in particular substantially kidney-shaped, control openings. The control openings penetrate the control plate in the axial direction and, at their opening into the control plate-side bearing face, have an inner and an outer circularly arcuate boundary line. Here, the openings of the passage openings into the cylinder barrel-side bearing face are arranged so as to be aligned in the axial direction with the inner and outer boundary lines of the control openings. This means the following in other words. The radii (spacings from the rotational axis of the cylinder barrel) of the inner and the outer boundary lines of the control openings correspond to the radial spacings of the inner edges and the outer edges of the openings of the passage openings into the cylinder barrel-side bearing face of the hydrostatic sliding bearing, and the radial spacings of the inner and the outer boundary lines of the control openings correspond to the diameters of the passage openings.

Up to now, the control openings have been arranged with regard to their radial dimension in the ratio to the radial dimension of the bearing face in such a way that a radial spacing between the inner boundary line of the control opening and the inner boundary of the hydrostatic sliding bearing is substantially the same size as a radial spacing between the outer boundary line of the control opening and the outer boundary of the hydrostatic sliding bearing.

In this configuration, a point of action of the relieving force which acts on the cylinder barrel-side bearing face of the cylinder barrel is arranged radially approximately in the middle between the inner and the outer boundary line of a control opening and radially approximately in the middle between the inner and outer circular boundary of the hydrostatic sliding bearing.

If, in this configuration, a control opening on the high-pressure side of the axial piston machine lies opposite an opening of one of the passage slots, a gap is formed between the cylinder barrel-side and the control plate-side bearing face of the hydrostatic sliding bearing, into which gap operating pressure medium penetrates. Said gap comprises a gap section which extends radially to the inside from the inner boundary line of the control openings, and a gap section which extends radially to the outside between the bearing faces from the outer boundary lines of the control openings. Said gap sections have the same length in the radial direction and, in the case of corresponding planarity of the bearing faces, substantially the same height in the axial direction. However, said gap sections have different widths in the circumferential direction of the circularly annular hydrostatic sliding bearing. As a consequence, the leakage flows for the operating pressure medium are likewise different as a result of said gap sections in operation, to be precise greater for the gap section which extends radially to the outside than for the gap section which extends radially to the inside.

This configuration can then be modified to the extent that a radial spacing between the inner boundary line of the control opening and the inner boundary of the hydrostatic sliding bearing is smaller than a radial spacing between the outer boundary line of the control opening and the outer boundary of the hydrostatic sliding bearing. In other words, the modification consists in that the radial position of the control openings with regard to the inner and outer boundary of the hydrostatic sliding bearing are arranged offset to the inside in the radial direction from a radial middle. One effect of this modification is that the gap section which extends to the inside is given a smaller length between the bearing faces, with the result that the leakage flow of operating pressure medium through said gap section becomes greater, and that the gap section which extends to the outside is given a greater length, with the result that the leakage flow through said gap section becomes smaller. As a result, firstly the leakage flows through the two gap sections are equalized at least partially. Secondly, in this configuration, a point of action or a line of action of the relieving force which acts on the cylinder barrel-side bearing face of the cylinder barrel is arranged radially further to the outside than the middle in the radial direction between the inner and outer circular boundary of the hydrostatic sliding bearing. This modification of the refinement of the hydrostatic sliding bearing therefore has an influence on the tilting moment which acts on the cylinder barrel, which influence can be realized in addition or as an alternative to the influences of the above-described embodiments according to the disclosure of the passage slots in the cylinder barrel.

The inner boundary line of the control opening is assigned an inner arc length which is measured along the inner boundary of the hydrostatic sliding bearing and defines substantially the same arc angle as the inner boundary line, and the outer boundary line of the control opening is assigned an outer arc length which is measured along the outer boundary of the hydrostatic sliding bearing and defines substantially the same arc angle as the outer boundary line. The ratio between the radial spacing from the inner boundary line to the inner boundary and the inner arc length is advantageously selected to be substantially as great as the ratio between the radial spacing from the outer boundary line to the outer boundary and the outer arc length. In this refinement, the leakage flows of operating pressure medium through the gap section which extends radially to the inside and the gap section which extends radially to the outside are substantially of the same magnitude, and an overall leakage flow is at a minimum.

BRIEF DESCRIPTION OF THE DRAWINGS

In the following text, embodiments of the disclosure will be explained in greater detail using diagrammatic drawings, in which.

DETAILED DESCRIPTION

Figure 1:
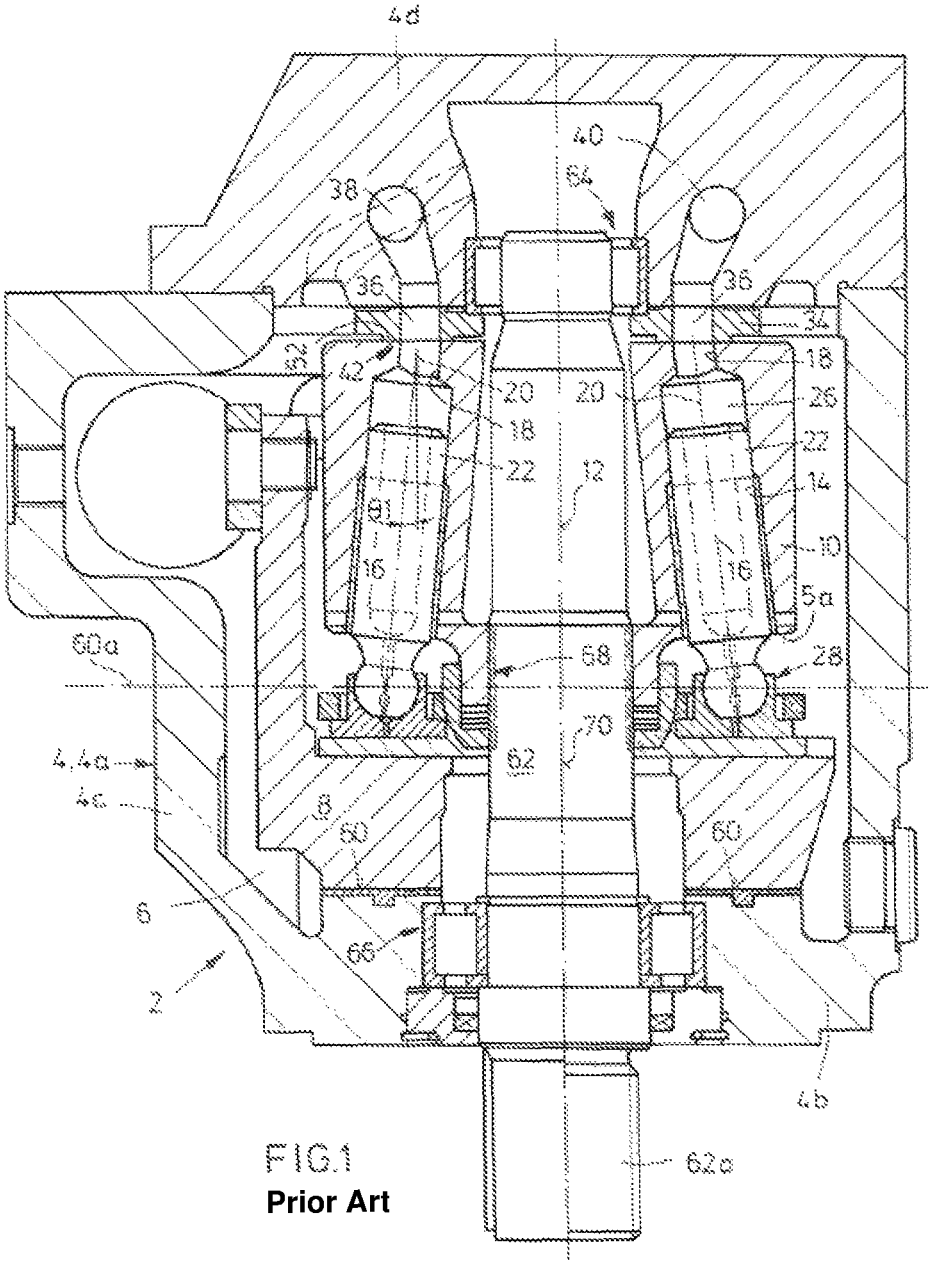
FIG.1 Prior Art
FIG. 1 shows an axial section of an axial piston machine in the configuration, in which the bearing faces of the cylinder barrel and control plate are of planar design, and the cylinder bores and the working pistons are arranged obliquely with respect to the rotational axis of the drive shaft, in accordance with the prior art.

The axial piston machine 2 which is shown in FIG. 1 and is designed by way of example for the configuration with bearing faces of planar design of the cylinder barrel and control plate and cylinder bores and working pistons which are arranged obliquely with respect to the rotational axis of the drive shaft comprises a housing 4, in the interior 6 of which there are, following one another axially, a swash plate 8, a cylinder barrel 10 with its rotational axis 12 and a substantially planar control plate 34 which is also called a control disk, and, furthermore, a drive shaft 62 which penetrates them with its rotational axis 70. The cylinder barrel 10 is arranged coaxially with respect to the drive shaft 62 and is coupled fixedly to the latter so as to rotate with it via a rotary driving device 68, for instance in the form of a toothed coupling. The cylinder barrel 10 bears with its end side which faces away from the swash plate 8 against the control plate 34 via a circularly annular, hydrostatic sliding bearing 42. Distributed on the circumference, cylinder bores 14 which are open toward the swash plate 8 with guide sleeves (not designated) and longitudinal axes 16 which are configured so as to be inclined at an acute angle Θ1 with regard to the rotational axes 12, 70 are arranged in the cylinder barrel 10. At the control plate-side end of the cylinder barrel 10, passage openings 18 which are configured coaxially with respect to the cylinder bores 14 with longitudinal axes 20 are provided. Preferably cylindrical working pistons 22 are mounted axially displaceably in the guide sleeves of the cylinder bores 14. At its control plate-side end, each working piston 22 delimits a working space 26 in the cylinder barrel 10. At the foot-side end, each working piston 22 is configured in the shape of a spherical head and is connected in an articulated manner to a piston shoe 28 which is supported on the swash plate 8 and slides on the swash plate 8 during rotation of the cylinder barrel 10. To this end, on the swash plate side, each piston shoe 28 has a planar sliding face (not designated) which bears against the swash plate 8 such that it can slide on a lubricating film which is formed by pressure medium.

Figure 5:
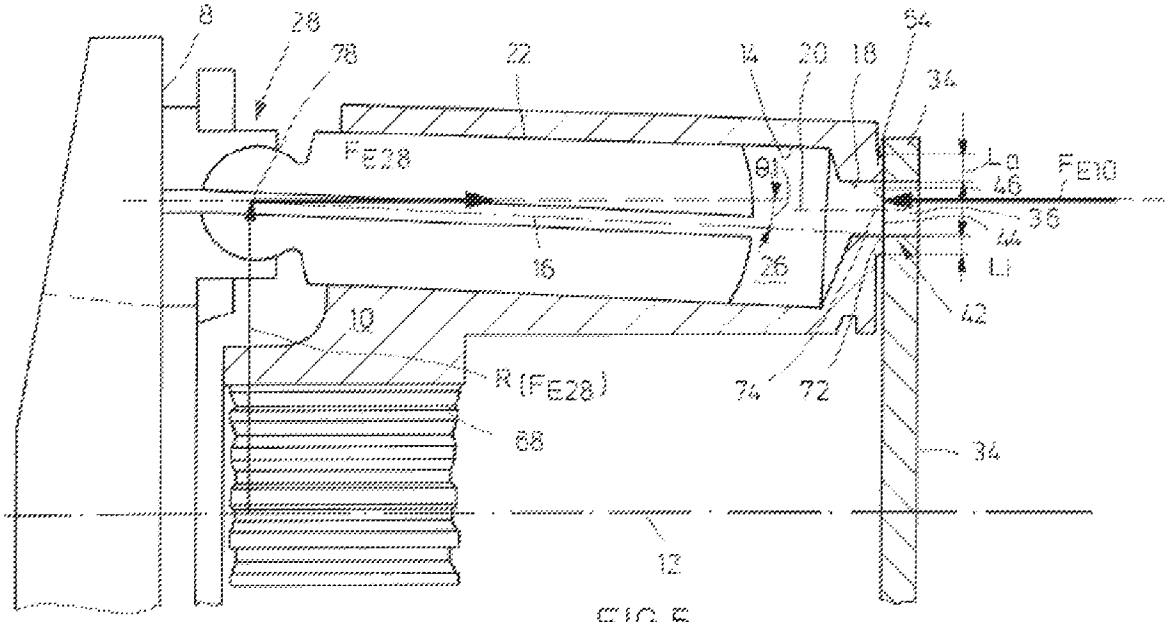
FIG. 5 shows an axial section of a cylinder barrel according to a second embodiment of the disclosure, which cylinder barrel bears against a planar control plate, and the relieving forces on the hydrostatic sliding bearing and on the piston shoe.
Figure 6:
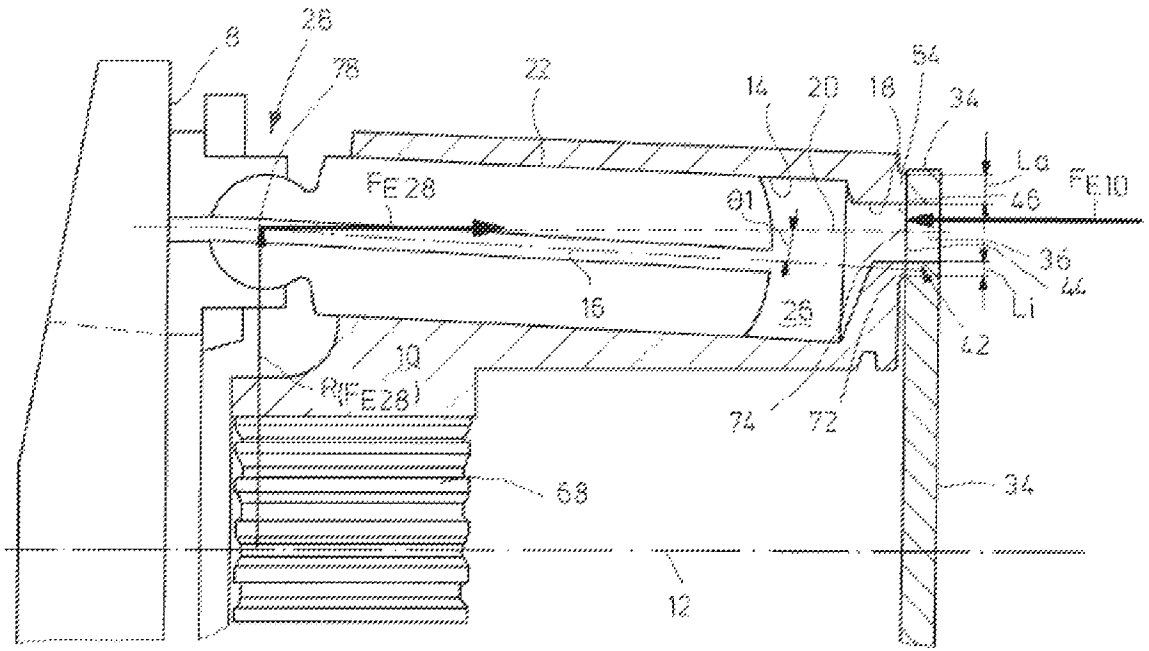
FIG. 6 shows an axial section of a cylinder barrel according to a third embodiment of the disclosure, which cylinder barrel bears against a planar control plate, and the relieving forces on the hydrostatic sliding bearing and on the piston shoe.

The housing 2 is formed from a cup-shaped housing part **4*a* with a housing bottom 4*b* and a housing shell 4*c* and a housing cover 4*d* which bears against a free edge of the housing shell 4*c* and is screwed thereto by means of screws (not shown). A feed line 38 and a discharge line 40 for feeding and discharging pressure medium to/from the working spaces 26 in the cylinder bores 14 are formed in the housing cover 4*d*. At least two control openings 36 are formed in the control plate 34 in the form of kidney-shaped through holes 36, as is also shown in FIGS. 5 and 6. The control openings 36 form sections of the feed line 38 and discharge line 40 which are formed in the housing cover 4*d***.

Figure 2:
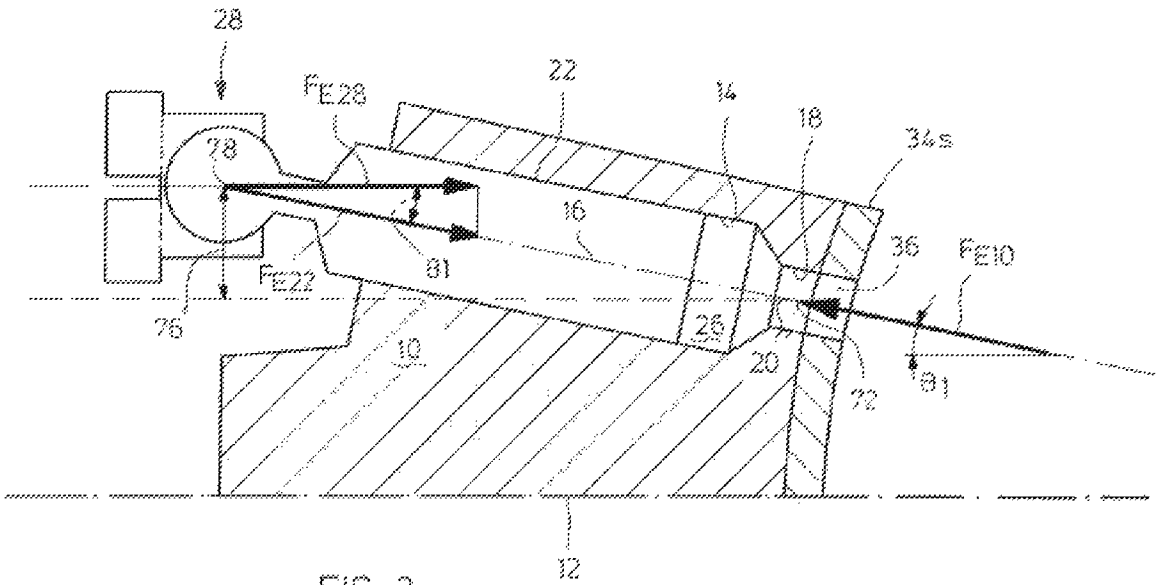
FIG. 2 Prior Art
FIG. 2 shows an axial section of a cylinder barrel which bears against a spherical control plate, with cylinder bores and working pistons which are configured obliquely with respect to the rotational axis, and the relieving forces on the hydrostatic sliding bearing and on the piston shoe in accordance with the prior art.
Figure 3:
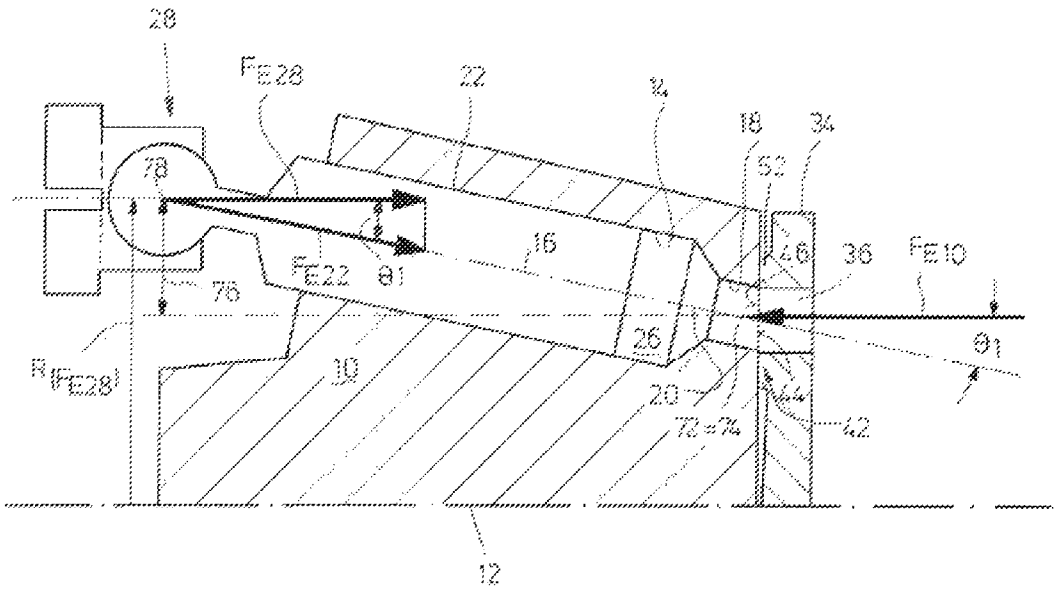
FIG. 3 shows an axial section of a cylinder barrel which bears against a planar control plate, with cylinder bores and working pistons which are configured obliquely with respect to the rotational axis, and the relieving forces on the hydrostatic sliding bearing and on the piston shoe in an axial piston machine according to FIG. 1.

In FIGS. 1 to 5, the passage openings 18 have a smaller diameter than the cylinder bores 14 and extend from the distal ends of the cylinder bores 14 as far as their openings into the cylinder barrel-side bearing face 44 of the hydrostatic sliding bearing 42. In FIGS. 1 to 3, the passage openings 18 are formed coaxially with the cylinder bores 14.

With regard to the connection of the working spaces or the cylinder bores in the cylinder barrel to the control openings in the control plate in axial piston machines with cylinder bores which run obliquely with respect to the rotational axis of the cylinder barrel and control plate of planar configuration, it has been known up to now that the cylinder bores open directly into the cylinder barrel-side bearing face of the hydrostatic sliding bearing, such as in DE 40 35 748 A1 (FIG. 2) which was cited at the outset, or via passage openings which are configured coaxially with the cylinder bores, as shown, for instance, in GB 1 073 216 which was cited at the outset or in the appended FIG. 1. In both cases, the longitudinal axis 16 of the cylinder bore 14 extends through a point of intersection 72 with the cylinder barrel-side bearing face 44 of the hydrostatic sliding bearing 42; said point of intersection 72 is to be considered to be a point of action 74 of the relieving force $F_{E10}$, which acts on the cylinder barrel 10, of the hydrostatic sliding bearing 42, as is shown in FIG. 3.

For improved comprehension and as a distinction with respect to the disclosure, FIG. 2 shows an axial section of a cylinder barrel 10 which bears against a spherical control plate **34*s* with cylinder bores 14 and working pistons 16 which are configured obliquely with respect to the rotational axis 12 of the cylinder barrel 12. Furthermore, FIG. 2 illustrates the relieving force $F_{E10}$ which is generated at the hydrostatic sliding bearing between the cylinder barrel 10 and the control plate 34*s* and acts on the cylinder barrel 10 and the relieving force $F_{E28}$, which is generated by way of the contact of the piston shoe 28 with the swash plate 8, for a swash plate (not shown in FIG. 2) which is arranged perpendicularly with respect to the rotational axis 12** in its basic position.

The relieving force $F_{E28}$ which is transmitted by the piston shoe 28 has a direction of action which is directed perpendicularly with respect to the swash plate 8, and is axial in the case of FIG. 2. According to a vector decomposition of the relieving force $F_{E28}$, a relieving force $F_{E22}$ acts on the working piston 22 in the axial direction of the working piston 22, that is to say in the longitudinal direction 16 of the cylinder bore 14. The acute angle Θ1, with which the longitudinal axis 16 of each cylinder bore 14 runs obliquely with respect to the rotational axis 12, is then at most approximately 5° or less in the known configurations. For small angles Θ1 of this type, the magnitude of the relieving force $F_{E28}$ which is absorbed by the piston shoe 28 is substantially equal to the relieving force $F_{E22}$ which acts axially on the working piston 22 ($\cos \Theta 1 \geq \cos 5° = 0.996$).

The relieving force $F_{E10}$ which acts on the cylinder barrel 10 from the spherical control plate 34*s* acts at the point of intersection 72 of the longitudinal axis 16 of the cylinder bore 14 in the direction perpendicularly with respect to the bearing faces of the spherical sliding bearing 34*s* and in the direction of the longitudinal axis 16 of the cylinder bores 14, that is to say in the opposite direction to the relieving force $F_{E22}$ which is transmitted from the piston shoe 28 to the working piston 22.

In order to comprehend the disclosure, FIG. 3 then shows an axial section of a cylinder barrel 10 which bears against a planar control plate 34 with cylinder bores 14 and working pistons 16 which are configured obliquely with respect to the rotational axis 12 of the cylinder barrel 12. Furthermore, FIG. 3 illustrates the relieving force $F_{E10}$ which is generated at the hydrostatic sliding bearing 42 between the cylinder barrel 10 and the planar control plate 34 and acts on the cylinder barrel 10 and the relieving force $F_{E28}$ which is generated by the contact of the piston shoe 28 with the swash plate 8 for a swash plate (not shown in FIG. 3) which is arranged perpendicularly with respect to the rotational axis 12 in its basic position.

As has already been explained with regard to FIG. 2, the relieving force $F_{E28}$ which is transmitted by the piston shoe 28 to the cylinder barrel 10 has a direction of action which is directed perpendicularly with respect to the swash plate 8 and is axial in the case of FIG. 3, with the component $F_{E22}$ which acts on the working piston 22 in its axial direction. The relieving force $F_{E10}$ which acts on the cylinder barrel 10 from the planar control plate 34 acts at the point of intersection 72 of the longitudinal axis 16 of the cylinder bore 14 in the direction perpendicularly with respect to the planar bearing faces 44 and 46 of the sliding bearing 42, that is to say in the direction parallel to the rotational axis 12 of the cylinder barrel 10, and in the opposite direction to the relieving force $F_{E28}$ which is transmitted from the piston shoe 28 to the cylinder barrel 10. On account of the oblique position of the cylinder bore 14 and depending on the axial spacing along the rotational axis 12 between the point of action 78 of the relieving force $F_{E28}$ and the point of action 74 of the relieving force $F_{E10}$, there is a radial offset 76 with regard to the rotational axis 12 between said points of action 74, 78 which are shown in FIG. 3, which radial offset 76 corresponds to the spacing of the lines of action of the relieving force $F_{E28}$ and the relieving force $F_{E10}$. On account of said radial offset 76 of the relieving force $F_{E28}$ from the piston shoe 28 and of the relieving force $F_{E10}$ of the hydrostatic bearing 42, a tilting moment is produced which acts on the cylinder barrel 10. As has already been said, the object of the disclosure then consists in making said tilting moment smaller or avoiding it. According to the disclosure, this is achieved by virtue of the fact that, for the cylinder bore 14, the point of action 74 or the line of action of the resulting hydrostatic relieving force $F_{E10}$, which acts on the cylinder barrel 10, of the hydrostatic sliding bearing 42 is arranged spaced apart radially with regard to the rotational axis 12 of the cylinder barrel 10 further than the point of intersection 72 of the longitudinal axis 16 of the cylinder bore 14 with the cylinder barrel-side bearing face 44 of the hydrostatic sliding bearing 42. The further the point of action 74 is spaced apart radially from the rotational axis 12 further, the smaller the axial offset 76 and the tilting moment which is caused as a result on the cylinder barrel 10.

Figure 4:
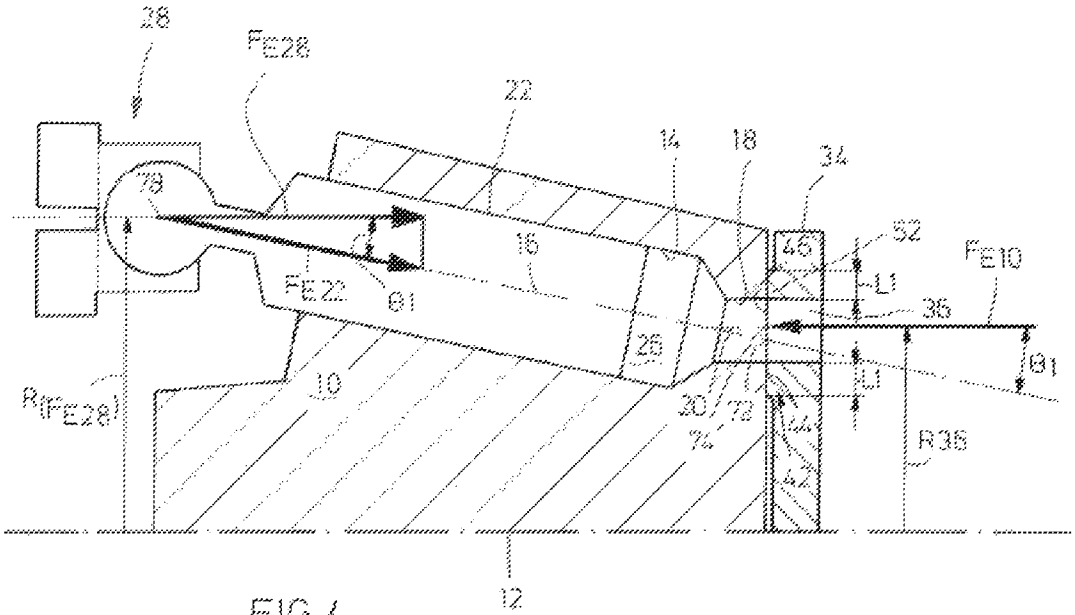
FIG. 4 shows a section (analogous to FIG. 3) of a cylinder barrel according to a first embodiment of the disclosure, which cylinder barrel bears against a planar control plate, and the relieving forces on the hydrostatic sliding bearing and on the piston shoe.

According to a first embodiment which is shown in FIG. 4, an approach of displacing the point of action 74 (and the line of action) of the relieving force $F_{E10}$ which acts on the cylinder barrel 10 radially further to the outside or so as to be spaced apart further from the rotational axis 12 consists in providing, at the distal end of each cylinder bore 14, a passage slot 18 which is of narrowed cross section in comparison with said cylinder bore 14 and has a longitudinal axis 20 which is arranged substantially parallel to the rotational axis 12 of the cylinder barrel 10. In the axial direction, the passage slot 18 bridges the spacing between the distal end of the cylinder bore 14 and the plane, in which the passage slot 18 opens at the point of action 74 of the relieving force $F_{E10}$ into the cylinder barrel-side bearing face 46 of the hydrostatic sliding bearing 42, the radial spacing R36 between its longitudinal axis 20 and the rotational axis 12 of the cylinder barrel 10 remaining substantially the same. In contrast, the longitudinal axis 16 of the cylinder bore 14 approaches the rotational axis 12 in the radial direction in the region of the axial extent of the passage slot 18 and intersects the cylinder barrel-side bearing face 46 of the hydrostatic sliding bearing 42 at the point of intersection 72. The radial offset between said point of intersection 72 and the point of action 74 of the relieving force $F_{E10}$ brings about the reduction in the axial offset 76 which is shown in FIG. 3 and the reduction which is desired according to the disclosure of the tilting moment on the cylinder barrel 10.

In the exemplary embodiment according to FIG. 5, in which the pistons lie less obliquely with respect to the rotational axis 12 than in the exemplary embodiments according to FIGS. 2 to 4, it is ensured that the point of action 74 of the relieving force $F_{E10}$ is spaced apart radially from the rotational axis 12 to the same extent as the point of action of the relieving force $F_{E28}$ on the piston shoe 28. As a result, the tilting moment on the cylinder is approximately zero.

This is achieved by virtue of the fact that, in a longitudinal axis 20 of each passage slot 18, which longitudinal axis 20 is still parallel to the rotational axis 12, the radial spacing of the passage slot 18 and the control opening 36 from the rotational axis 12 is enlarged in comparison with a position centrally with respect to the control plate-side end region of the cylinder bores 14. The longitudinal axes 20 of the passage slot 18 and the control opening 36 are at a smaller spacing from the rotational axis 12 than the line of action of the forces $F_{E10}$ and $F_{E28}$ d. Moreover, the length $L_i$ of the gap section which extends to the inside is smaller than the length $L_a$ of the gap section which extends to the outside of the hydrostatic sliding bearing 42. Both measures lead to the point of action of the force $F_{E10}$ migrating to the outside further away from the rotational axis 12.

In the exemplary embodiment according to FIG. 6, the longitudinal axis 20 of the passage slot 18 and the control opening 36 is situated so far away from the rotational axis 12, as in the exemplary embodiment according to FIG. 5, that the line of action of the force $F_{E28}$ lies on the longitudinal axis 20. In addition, the length $L_i$ of the gap section which extends to the inside is smaller and the length $L_a$ of the gap section which extends to the outside of the hydrostatic sliding bearing 42 is larger than in the exemplary embodiment according to FIG. 5. This leads to the line of action of the relieving force $F_{E10}$ being radially further away from the rotational axis than the line of action of the force $F_{E28}$. The special advantage of this exemplary embodiment in comparison with the exemplary embodiment according to FIG. 5 lies in the fact that the rotational speed is increased, at which the cylinder barrel 10 tends to rise up from the control plate. The special advantage of the exemplary embodiment according to FIG. 5 in comparison with the exemplary embodiment according to FIG. 6 lies in the higher rotational speed, at which self-suction still occurs. This is as a result of the smaller spacing of the passage slots 18 and the control openings in the control plate 34 from the rotational axis 12.

Here, the acute angle Θ1 of the obliquely running longitudinal axis 16 of the cylinder bore 14 with respect to the rotational axis 12 is approximately 2°. In general, it can be up to 5° in size. The established range lies between 1 and 4°.

Figure 7:
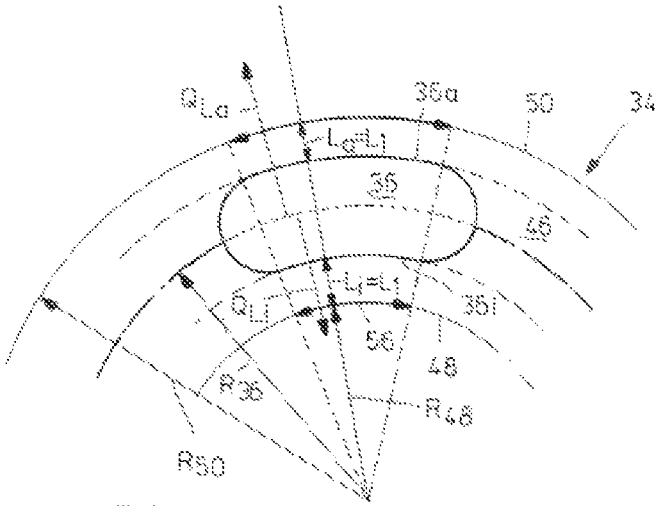
FIG. 7 shows a view in the axial direction of a detail of a planar control plate with a control opening according to a known embodiment of a control plate.
Figure 8:
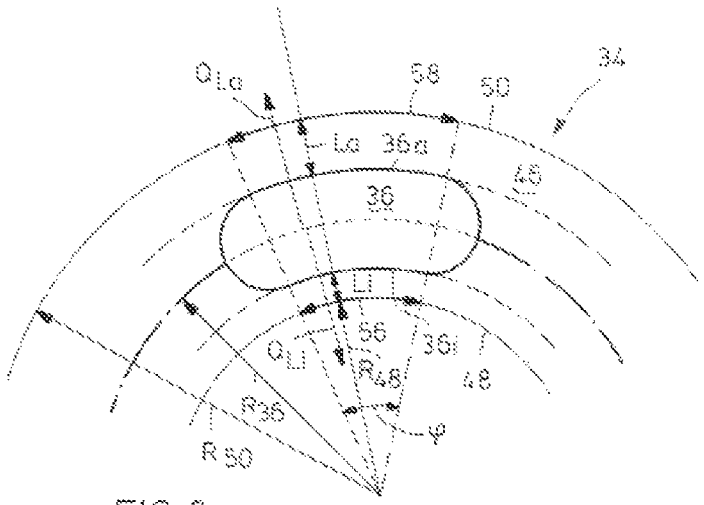
FIG. 8 shows a view in the axial direction of a detail of a planar control plate with a control opening according to a further embodiment according to the disclosure.

FIGS. 7 and 8 show views in the axial direction of a detail of a planar control plate 34 with its surface which faces the cylinder barrel 10 in the state in which it is installed into an axial piston machine. Said surface forms the control plate-side bearing face 46 of the hydrostatic sliding bearing 42 which is otherwise of annular configuration and, in addition to the control plate-side bearing face 46, comprises the cylinder barrel-side bearing face 44 (shown in FIGS. 3 to 6) and has an inner circular boundary 48 and an outer circular boundary 50. The inner and outer boundary 48 and 50 of the hydrostatic sliding bearing 42 are either configured by virtue of the fact that the control plate-side bearing face 46 is configured as an annular elevation 52 which projects from that side of the control plate 34 which faces the cylinder barrel 10, as shown in FIGS. 1, 3 and 4, or by virtue of the fact that the cylinder barrel-side bearing face 44 is configured as an annular elevation 54 which projects from that side of the cylinder barrel 10 which faces the control plate 34, as shown in FIGS. 5 and 6. In both cases, a step is formed on the inner circumference and on the outer circumference of the annular elevation, as shown in FIGS. 3 to 6. The control plate 34 is of substantially annular configuration and has at least two substantially kidney-shaped control openings 36, of which in each case only one is shown in FIGS. 7 and 8. Each control opening 36 penetrates the control plate 34 in the axial direction and has an inner and an outer circularly arcuate boundary line **36*i* and 36*a* at its opening into the control plate-side bearing face 46. The opening of each passage opening 18 of the cylinder barrel 10 into the cylinder barrel-side bearing face 44 of the hydrostatic sliding bearing 42 is arranged so as to be aligned axially with the inner and outer boundary lines 36*i* and 36*a* of each control opening 36. That is to say, in other words, the radii, that is to say the spacings from the rotational axis 12 of the cylinder barrel 10, of the inner boundary line 36*i* and the outer boundary line 36*a* correspond for each control opening 36 to the radial spacings of the inner edges and the radial spacings of the outer edges of the openings of the passage openings 18 into the cylinder barrel-side bearing face 44 of the hydrostatic sliding bearing 48, and the radial spacing between the inner boundary line 36*i* and the outer boundary line 36*a* correspond to the diameters of the passage openings 18 at their openings into the cylinder barrel-side bearing face 44 of the hydrostatic sliding bearing 48**.

In the embodiment (shown in FIG. 7) of the hydrostatic sliding bearing 42 which has been customary up to now, each control opening 36 is arranged with regard to its radial dimension in ratio to the radial dimension of the control plate-side bearing face 46 in such a way that a radial spacing $L_1$ between the inner boundary line **36*i* of the control opening 36 and the inner boundary 48 of the hydrostatic sliding bearing 42 is substantially the same size as a radial spacing $L_1$ between the outer boundary line 36*a* of the control opening 36 and the outer boundary 50 of the hydrostatic sliding bearing 42**.

For the embodiment which is shown in FIG. 7, the point of action 74 of the relieving force $E_{E10}$ which acts on the cylinder barrel-side bearing face 44 of the cylinder barrel 10 is arranged radially approximately in the middle between the inner and the outer boundary line **36*i* and 36*a* of the control opening 36. That is to say, the point of action 74 is arranged on the pitch circle of the control openings 36 with the pitch circle radius $R_{36}$ and radially approximately in the middle between the inner and outer circular boundary 48 and 50 of the hydrostatic sliding bearing 42** which are assigned the radii $R_{48}$ and $R_{50}$.

If, in this configuration, a control opening 34 on the high pressure side of the axial piston machine 2 lies opposite an opening of one of the passage slots 18 in the cylinder barrel 10 during operation of said axial piston machine 2, a gap is formed between the cylinder barrel-side and the control plate-side bearing face 44 and 46 around the passage opening 36 on account of the high pressure which is generated by way of loading with an operating pressure medium. Said gap comprises a part section which extends radially to the inside from the inner boundary line **36*i* of the control opening 34 and a part section which extends radially to the outside from the outer boundary line 36*a* of the control opening 36. Said part sections have the same length in the radial direction and substantially the same height in the axial direction in the case of corresponding planarity of the bearing faces 44 and 46. However, said part sections have different widths in the circumferential direction of the circularly annular hydrostatic sliding bearing 42**. As a consequence, during operation, the leakage flows $Q_i$ for the operating pressure medium through the gap section which extends radially to the inside is smaller than the leakage flows $Q_a$ through the gap section which is directed radially to the outside.

As shown in FIG. 8, this embodiment of the hydrostatic sliding bearing 42 and, in particular, of the control plate 34 can be modified in such a way that, for each control opening 36, the radial spacing $L_i$ between the inner boundary line **36*i* and the inner boundary 48 of the hydrostatic sliding bearing 42 is smaller than a radial spacing $L_a$ between the outer boundary line 36*a* and the outer boundary 50 of the hydrostatic sliding bearing 42. In other words, this modification consists in that the radial position of each control opening 36 is arranged offset to the inside in the radial direction from the radial middle, as shown in FIG. 7, with regard to the inner and outer boundary 48 and 50 of the hydrostatic sliding bearing 42, as is shown in FIG. 8, for example. One effect of this modification is that the gap section which extends radially to the inside from the inner boundary line 36*i* between the bearing faces 44, 46 is given as smaller length $L_i$, with the result that the leakage flows $Q_i$ through said gap section for the operating pressure medium becomes greater, and that the gap section which extends radially to the outside from the outer boundary line 36*a* is given a greater length $L_a$, with the result that the leakage flow $Q_a$ through said gap section becomes smaller. As a result, firstly the leakage flows $Q_i$ and $Q_a$ through the two gap sections are equalized at least partially. Secondly, in this configuration, a point of action or a line of action of the relieving force $F_{E10}$ which acts on the cylinder barrel-side bearing face 44 of the cylinder barrel 10 is arranged radially further to the outside than the middle in the radial direction between the inner and outer circular boundary 48 and 50 of the hydrostatic sliding bearing 42. This modification of the design of the hydrostatic sliding bearing 42 therefore has an influence on the tilting moment which acts on the cylinder barrel 10. This influence or this modification can be realized in addition or as an alternative to the influences of the designs of the passage slots 18 in the cylinder barrel 10 which are described with regard to FIGS. 4 to 6**.

As can be gathered from FIG. 8, the inner boundary line **36*i* of the control opening 36 is assigned an inner arc length 56 which is measured along the inner boundary 48 of the hydrostatic sliding bearing 42 and defines substantially the same arc angle ϕ as the inner boundary line 36*i*. Furthermore, the outer boundary line 36*a* of the control opening 36 is assigned an outer arc length 58 which is measured along the outer boundary 50 of the hydrostatic sliding bearing 42 and defines substantially the same arc angle ϕ as the outer boundary line 36*a*. The radial arrangement of the control opening 36 or the boundary lines 48 and 50 is advantageously selected in such a way that the leakage flows $Q_i$ and $Q_a$ of operating pressure medium through the gap section which extends radially to the inside from the inner boundary line 36*i* and the gap section which extends radially to the outside from the outer boundary line 36*i* are substantially of the same size, because the overall leakage flow is then at a minimum. The following condition arises from the requirement that $Q_i$ is equal to $Q_a$ and under consideration of the fact that each of said leakage flows is proportional to the variable (gap width measured in the circumferential direction×gap height measured in the axial direction/gap length measured in the radial direction): 56×gap height/$L_i$=58×gap height/$L_a$; and the following condition follows as a result of cancelling out the gap height: $(56/L_i)=(58/L_a)$. In order to minimize the overall leakage flow, the ratio $L_i/56$ between the radial spacing $L_i$ from the inner boundary line 36*i* into the inner boundary 48 and the inner arc length 56 is therefore to be selected to be substantially the same as the ratio $L_a/58$ between the radial spacing $L_a$ from the outer boundary line 36*a* to the outer boundary 50 and the outer arc length 58. According to this condition, the radius $R_{36}$ of the pitch circle of the control opening 36 is smaller in FIG. 8 than in FIG. 7 for otherwise identical (radial) dimensions $R_{48}$ and $R_{50}$ of the control plate-side bearing faces 46**.

The tilting moment on the cylinder barrel 10 is substantially avoided or eliminated if the point of action 74 of the resulting hydrostatic relieving force $F_{E10}$, which acts on the cylinder barrel 10, of the hydrostatic sliding bearing 42, which corresponds to the radius $R_{36}$ of the pitch circle of the control opening 36 is at the same spacing from the rotational axis 12 of the cylinder barrel as the point of action 78 of the relieving force $F_{E28}$ which acts on the cylinder barrel 10 at the piston shoe 28, or, in other words, if the line of action of the relieving force $F_{E10}$ of the hydrostatic sliding bearing 42 on the line of action of the relieving force $F_{E28}$ coincide at the piston shoe 28.

For an axial piston machine of swash plate design, in which the longitudinal axes of the cylinder bores are arranged at an acute angle with the rotational axis and the cylinder bores approach the rotational axis radially in the direction of their control plate-side ends, it is disclosed that, for each cylinder bore, a point of action of a resulting hydrostatic relieving force, which acts on the cylinder barrel, of the hydrostatic sliding bearing is spaced apart radially with regard to the rotational axis of the cylinder barrel further than a point of intersection of the longitudinal axis of the cylinder bore with the cylinder barrel-side bearing face of the hydrostatic sliding bearing.

A hydrostatic axial piston machine according to the disclosure of swash plate design can particularly advantageously be used as a component of a hydraulic hybrid drive in a motor vehicle, in particular in a passenger motor vehicle. In vehicles, in particular, it comes down to a satisfactory degree of efficiency with low costs, a compact design and high rotational speeds which can be achieved.

What is claimed is:

1. A hydrostatic axial piston machine of swash plate design, comprising:

a cylinder barrel mounted so as to rotate about a rotational axis, the cylinder barrel defining a multiplicity of cylinder bores, each of which is delimited in sections by one respective working piston and, during rotation of the cylinder barrel, is connected to high pressure or low pressure via a planar control plate having a first planar surface that bears against a first end side of the cylinder barrel via a first bearing face and a second bearing face of a hydrostatic sliding bearing;

a swash plate mounted pivotably in a pivoting bearing and on which piston shoes arranged at a swash plate-side end region of each of the respective working pistons slide during the rotation of the cylinder barrel, wherein each cylinder bore has a central longitudinal axis arranged at an acute angle with respect to the rotational axis and which is radially closer to the rotational axis at the first end side of the cylinder barrel, wherein, during operation of the hydrostatic axial piston machine, the hydrostatic sliding bearing is configured so as to produce a hydrostatic relieving force acting on the cylinder barrel which, for each cylinder bore, acts at a first point of action, the first point of action being spaced apart radially from the rotational axis of the cylinder barrel by a first distance, which is greater than a second distance between the rotational axis and a first point of intersection of the central longitudinal axis of the cylinder bore with the first bearing face, which is on a cylinder-barrel side of the hydrostatic sliding bearing.

2. The axial piston machine according to claim 1, wherein the first distance is equal to or greater than a third distance between the rotational axis and a second point of action of a resulting relieving force, which, during operation of the axial piston machine, acts on the cylinder barrel, for each respective working piston, at a bearing face of the piston shoe of the respective working piston bearing on the swash plate.

3. The axial piston machine according to claim 1, wherein:

the cylinder barrel defines a multiplicity of passage slots, each of which is assigned to a respective cylinder bore of the multiplicity of cylinder bores, extends from a distal end of the respective cylinder bore to the first bearing face of the hydrostatic sliding bearing, and has a cross-sectional area defined in a plane normal to a longitudinal axis of the passage slot that is less than a cross-sectional area of the respective cylinder bore defined in a plane normal to the central longitudinal axis of the respective cylinder bore; and the longitudinal axes of the passage slots are arranged substantially parallel to the rotational axis of the cylinder barrel.

4. The axial piston machine according to claim 3, wherein the longitudinal axis of the passage slot assigned to each working piston, at a control-plate side end of the passage slot, is spaced apart radially for each said working piston from the rotational axis of the cylinder barrel by a third distance, which is equal to or greater than a fourth distance between the rotational axis and a second point of action of a relieving force that acts on a swash plate end of the piston shoe of the respective working piston on a bearing face of the piston shoe in an axial direction of the respective working piston.

5. The axial piston machine according to claim 1, wherein:

the hydrostatic sliding bearing is of annular configuration, and has an inner circular boundary and an outer circular boundary;

the control plate is of substantially annular configuration and has at least two control openings which penetrate the control plate in an axial direction of the control plate and which have an inner and an outer circularly arcuate boundary line at an opening to the second bearing face; and passage openings open into the first bearing face so as to be aligned in the axial direction with the inner and outer boundary lines of the control openings.

6. The axial piston machine according to claim 5, wherein a radial spacing between the inner boundary line of the control opening and the inner boundary of the hydrostatic sliding bearing is substantially the same size as a radial spacing between the outer boundary line of the control opening and the outer boundary of the hydrostatic sliding bearing.

7. The axial piston machine according to claim 5, wherein a radial spacing between the inner boundary line of the control opening and the inner boundary of the hydrostatic sliding bearing is smaller than a radial spacing between the outer boundary line of the control opening and the outer boundary of the hydrostatic sliding bearing.

8. The axial piston machine according to claim 7, wherein:

the inner boundary line of the control opening is assigned an inner arc length which is measured along the inner boundary of the hydrostatic sliding bearing and defines substantially the same arc angle as the inner boundary line;

the outer boundary line of the control opening is assigned an outer arc length which is measured along the outer boundary of the hydrostatic sliding bearing and defines substantially the same arc angle as the outer boundary line; and a ratio between a radial spacing from the inner boundary line to the inner boundary and the inner arc length is substantially identical to a ratio between the radial spacing from the outer boundary line to the outer boundary and the outer arc length.

9. The axial piston machine according to claim 5, wherein the control openings are configured as substantially kidney-shaped control openings.

10. A hydrostatic axial piston machine of swash plate design, comprising:

a cylinder barrel mounted so as to rotate about a rotational axis, the cylinder barrel defining a multiplicity of cylinder bores, each of which is delimited in sections by one respective working piston and, during rotation of the cylinder barrel, is connected to high pressure or low pressure via a planar control plate that bears against a first end side of the cylinder barrel via bearing faces of a hydrostatic sliding bearing;

a swash plate mounted pivotably in a pivoting bearing and on which piston shoes arranged at a swash plate-side end region of each of the respective working pistons slide during the rotation of the cylinder barrel, wherein each cylinder bore has a longitudinal axis arranged at an acute angle with respect to the rotational axis and which is radially closer to the rotational axis at the first end side of the cylinder barrel, wherein the cylinder barrel defines a multiplicity of passage slots, each of which is assigned to a respective cylinder bore of the multiplicity of cylinder bores and extends from a distal end of the respective cylinder bore to a cylinder-barrel side bearing face of the hydrostatic sliding bearing, wherein longitudinal axes of the passage slots are arranged substantially parallel to the rotational axis of the cylinder barrel, and wherein the longitudinal axes of the passage slots are spaced apart radially from the rotational axis of the cylinder barrel further than points of intersection of the longitudinal axes of the cylinder bores with a plane which is arranged perpendicularly with respect to the rotational axis and contains cylinder bore-side ends of the passage slots.

11. The axial piston machine according to claim 10, wherein the longitudinal axes of the passage slots are spaced apart radially from the rotational axis of the cylinder barrel at the cylinder bore-side ends of the passage slots further than the points of intersection of the longitudinal axes of the cylinder bores with the plane which is arranged perpendicularly with respect to the rotational axis and contains the cylinder bore-side ends of the passage slots.

12. The axial piston machine according to claim 10, wherein the hydrostatic sliding bearing is configured so as to produce a hydrostatic relieving force acting on the cylinder barrel which, for each cylinder bore, acts at a first point of action, the first point of action being spaced apart radially from the rotational axis of the cylinder barrel by a first distance, which is greater than a second distance between the rotational axis and a point of intersection of the longitudinal axis of the cylinder bore with the first bearing face, which is on a cylinder-barrel side of the hydrostatic sliding bearing.

* * * * *